US006502785B1

(12) United States Patent
Teter et al.

(10) Patent No.: US 6,502,785 B1
(45) Date of Patent: Jan. 7, 2003

(54) THREE AXIS FLAP CONTROL SYSTEM

(75) Inventors: Roger D. Teter, Sunnyvale, CA (US); Dean A. Kudlick, Mountanin View, CA (US); Richard M. Williams, San Ramon, CA (US)

(73) Assignee: Lockheed Martin Corporation, Bethesda, MD (US)

( * ) Notice: Subject to any disclaimer, the term of this patent is extended or adjusted under 35 U.S.C. 154(b) by 7 days.

(21) Appl. No.: 09/714,455

(22) Filed: Nov. 17, 2000

Related U.S. Application Data

(60) Provisional application No. 60/165,920, filed on Nov. 17, 1999.

(51) Int. Cl.[7] ..... G06E 19/00; F42B 10/00

(52) U.S. Cl. ..... 244/3.22; 244/3.24; 244/3.28; 244/3.29; 244/3.27

(58) Field of Search ..... 244/3.21, 3.22, 244/3.24, 3.25, 3.26, 3.27, 3.28

(56) References Cited

U.S. PATENT DOCUMENTS 412,670 A * 10/1889 Ross ..... 102/376
1,243,542 A * 10/1917 Moore ..... 102/400
2,941,764 A * 6/1960 Lee, Jr. et al. ..... 244/1 R
3,125,313 A * 3/1964 Soderberg ..... 244/1 R
3,287,019 A * 11/1966 Arthur ..... 244/1 R
3,365,147 A * 1/1968 Wolfe ..... 244/169
3,398,916 A * 8/1968 Van Vyve ..... 313/385
3,624,367 A * 11/1971 Hamilton et al. ..... 244/3.2
3,724,782 A * 4/1973 Gauzza et al. ..... 102/384
3,776,490 A * 12/1973 Dieter ..... 244/3.21
3,990,656 A * 11/1976 Minnich ..... 244/3.27
4,373,688 A * 2/1983 Topliffe ..... 244/3.24
4,492,166 A * 1/1985 Purcell ..... 102/384
4,600,167 A * 7/1986 Kastenhuber et al. ..... 102/385
4,624,424 A * 11/1986 Pinson ..... 102/384
4,648,567 A * 3/1987 Maudal et al. ..... 228/180.1
4,699,333 A * 10/1987 George ..... 244/3.21
4,739,412 A * 4/1988 Ozunas ..... 244/3.16
5,037,040 A * 8/1991 Goltz et al. ..... 244/3.22
5,069,135 A * 12/1991 Johansson et al. ..... 102/275.5
5,211,358 A 5/1993 Bagley
5,259,569 A * 11/1993 Waymeyer et al. ..... 244/3.21
5,282,588 A * 2/1994 August ..... 244/3.27
5,398,887 A * 3/1995 Wassom et al. ..... 244/3.22
5,564,652 A 10/1996 Trimbath
5,871,173 A * 2/1999 Frank et al. ..... 244/1 TD
5,975,461 A 11/1999 Ullrich
6,073,880 A * 6/2000 Voigt et al. ..... 244/3.24
6,168,111 B1 * 1/2001 Kayser et al. ..... 244/3.24
RE37,331 E * 8/2001 Schroeder ..... 244/3.21
6,308,911 B1 * 10/2001 Schroeder ..... 244/3.1
6,347,763 B1 * 2/2002 Harkins et al. ..... 244/3.15

* cited by examiner

*Primary Examiner*—Charles T. Jordan
*Assistant Examiner*—Stephen A. Holzen
(74) *Attorney, Agent, or Firm*—Swidler Berlin Shereff Friedman, LLP

(57) ABSTRACT

A three axis control system employing four flaps is disclosed. The flaps are of uniform design, which decreases machining and manufacturing costs. The flaps are positioned on a vehicle orthogonally, but offset from a vehicle centerline. The system provides not only pitch and yaw control, but also bi-directional roll control with a minimum number of parts and minimal infringement of packaging envelope. The system provides quick response and increased capability for difficult maneuvers and is useable for hypersonic/supersonic applications.

18 Claims, 5 Drawing Sheets

THREE AXIS FLAP CONTROL SYSTEM

REFERENCE TO PROVISIONAL APPLICATION

This application claims priority of provisional application Serial No. 60/165,920, filed Nov. 17, 1999.

BACKGROUND OF THE INVENTION

1. Field of the Invention

The present invention relates generally to the field of aerodynamics, and more specifically, to a system of deployable control surfaces and an associated control system for effecting yaw, pitch and roll control of a vehicle. The system includes a plurality of deployable flaps whose respective centerlines are offset from the radius of the vehicle. Selective deployment of the flaps will result in a desired pitch, yaw and/or movement of the vehicle.

2. Description of the Related Art

Aerodynamic control systems for use in rocket launched projectiles are generally known. A particular control situation arises after the motor of a rocket or other such vehicle has fired, and the vehicle continues to move in what is commonly called a "coasting" mode of operation. During vehicle coasting, there is a need for aerodynamic control to guide the vehicle.

Prior attempts to provide such a coasting guidance system have employed aero fins to achieve control during coast periods. The use of fins, however, can significantly reduce the number of missiles which can be packaged into a given cross section, such as the payload bay of an airplane or ship. Consequently, designs have been proposed which utilize flaps or panels which lie flush with the skin of the missile when not in use but which can be actuated to extend into the airstream to control the missile.

A significant disadvantage to the use of known flap designs is the difficulty of incorporating a design that effectively achieves roll control in addition to yaw and pitch control. Since most guided projectiles require some form of roll control, a system without roll control would likely require steering schemes, such as bank-to-turn, which require more time and therefore limit controllability.

In U.S. Pat. No. 5,398,887 to Wassom et al., a control system is disclosed for use with missiles and other projectiles. The control system provides pitch, roll and yaw control by actuating two (2) pairs of flaps disposed at the base of the projectile. Each flap is deployable on command by pivoting about a pivot axis disposed at the leading edge of the flap. The pivot axis is oriented at a first oblique angle to the radial plane of the projectile. Each flap is curved in a shape corresponding to the contour of the projectile body. The oblique angle of the pivot axis of one pair of flaps is opposite the oblique angle of the other pair of flaps.

The design of Wassom et al. has several disadvantages. First, the flaps are not of uniform design, which increases machining and manufacturing costs. Second, to obtain pure pitch or yaw control, the angles of the flaps must be paired in precise mirror images in order to avoid creating a roll force, which also increases machining and manufacturing costs. Finally, for hypersonic applications, the oblique hinging may create heating and/or mechanical interface problems and also adversely affect roll control.

U.S. Pat. No. 5,211,358 to Bagley describes a plurality of deployable fins which are moveable from a stowed position to a deployed position after launch by inflation of air bags. After launch, or after lowering of a launch platform in the case of aircraft, an actuator opens a valve supplying gas to inflate the bags. After the fin is locked into position, the airbag either rapidly deflates or is decoupled from the missile structure. The fins provide stabilization rather than pitch, roll or yaw control, however.

U.S. Pat. No. 5,975,461 to Ullrich discloses a vane control system for a guided missile, in which four vanes are disposed on the fuselage of the missile at a forward portion thereof. The vanes are deployable by actuation of a gear-and-motor arrangement whereby rotation of a gear causes the vanes to extend outwardly from a retracted position. As with the Bagley reference, the vanes appear to provide stabilization as opposed to pitch, roll and/or yaw control.

U.S. Pat. No. 5,564,652 to Trimbath describes a body spoiler for yaw control of a supersonic airplane. At the fore body of the fuselage, a plurality of spoilers are disposed, flush with the outer surface in a non-deployed position. The illustrated embodiment describes eight (8) spoilers arranged at equal radially spaced intervals. The patent describes deployment of the spoiler on the same side of the aircraft fuselage as a failed engine. The spoiler generates a shock wave which in turn produces pressure along the fore body thereby creating a yaw moment that substantially counterbalances the yaw moment generated by the malfunctioning engine. It is noted in the patent that a plurality of the radially disposed spoilers can be used to generate other forces, such as by deploying spoilers under the fuselage, an upward pitch movement is generated.

Although the aforementioned patents describe the use of control surfaces to achieve certain aerodynamic effects, a continuing need exists for a relatively simple structure for effecting pitch, yaw and/or roll movement in a vehicle.

SUMMARY OF THE INVENTION

It is an object of the present invention to provide an improved three axis flap control system.

It is a further object of the present invention to provide pitch, yaw, and roll control with a minimum number of parts and minimal infringement of packaging envelope.

It is a further object of the present invention to provide a control system that is variable to allow for a variety of vehicle loading conditions.

It is a further object of the present invention to minimize machining and manufacturing costs associated with a three axis flap control system.

The present invention provides a vehicle control system that provides pitch, yaw, and roll control. The control system includes a sensor, a controller, actuators, and four flaps. The flaps are positioned on the vehicle orthogonally, but offset from the vehicle centerline. By engaging various pairs of the flaps, any desired vehicle orientation may be achieved. The flaps are independently controlled. The flaps may be engaged to any desired angle of engagement, from none to the maximum possible.

BRIEF DESCRIPTION OF THE DRAWINGS

The present invention is described with reference to the accompanying drawings, in which like reference characters reference like elements, and wherein.

DETAILED DESCRIPTION OF THE INVENTION

Figure 1:
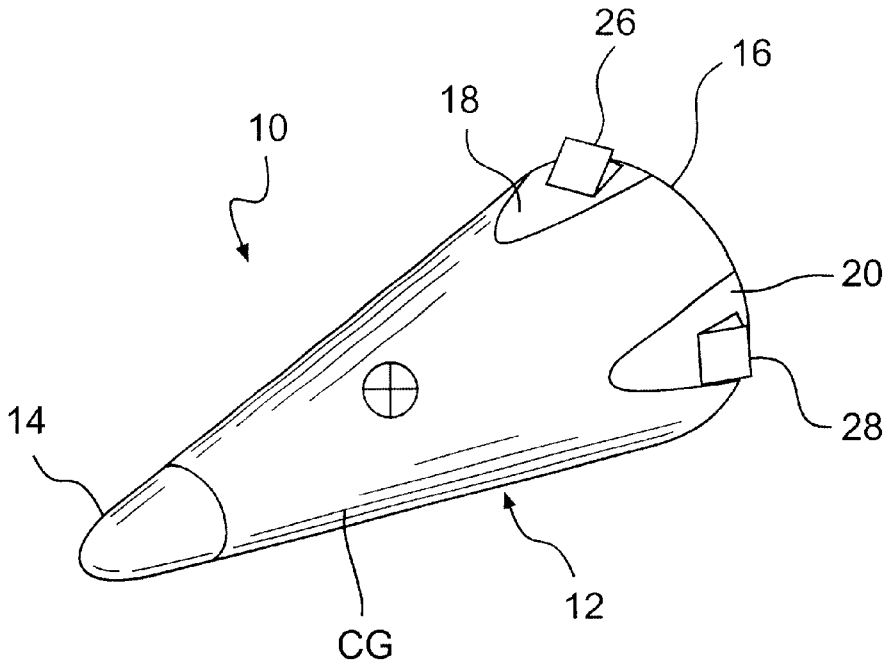
FIG. 1 is a perspective view of a vehicle having the control flaps according to the present invention.
Figure 2:
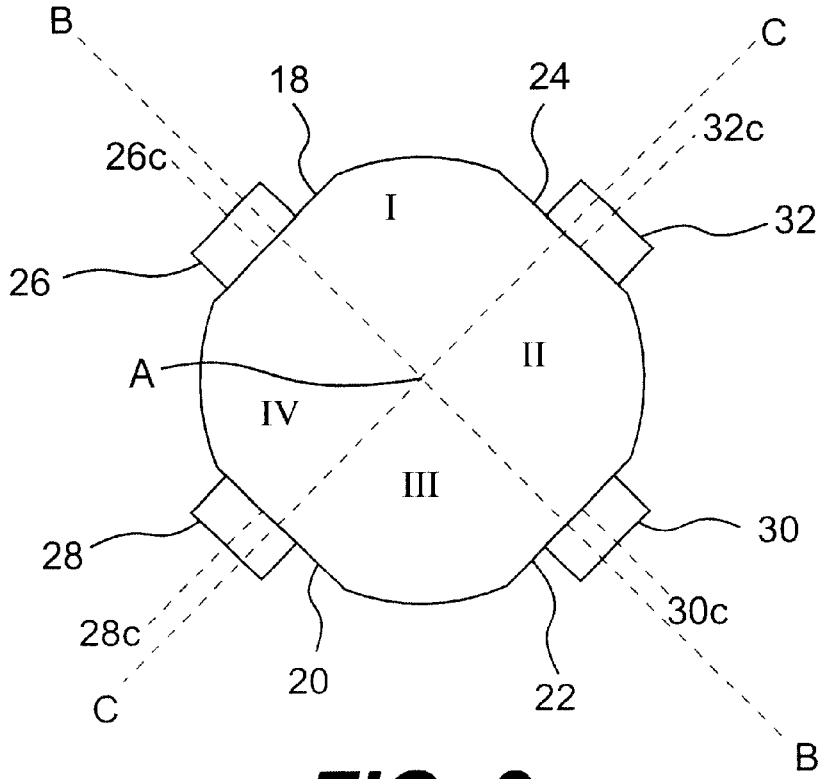
FIG. 2 is a rear, schematic view of the vehicle of FIG. 1, showing four flaps in a deployed position.

Referring to FIGS. 1 and 2, a vehicle 10 is shown in the form of a projectile of the type that can be propelled by a rocket (not shown) at hypersonic speeds. The vehicle 10 includes a body 12 having a pointed forward end 14 and an aft end 16. The body 12 between the opposite ends 14 and 16 is substantially conically shaped, except for four planar sections 18, 20, 22 and 24. As is usually the case with a projectile, in order to maintain stable flight, the center of gravity CG is forward of the moment of resistance.

Four control surfaces or flaps 26, 28, 30, and 32 are pivotally mounted by their respective leading edges on the body 12 at respective planar sections 18, 20, 22 and 24. Each flap is pivotally mounted for movement between a stowed, non-deployed position, and an un-stowed, deployed position. When in the stowed position, the outer surface of each flap is flush with the respective planar section surface to thereby avoid drag; at this position, the flap is in a zero degree of deployment. When deployed, each flap is moved by an actuator to a desired degree of deployment. The full limit of deployment can be limited by the particular application, meaning the type of vehicle, its aerodynamic characteristics, and the projected flight characteristics and control requirements. The flaps illustrated in FIG. 1, flaps 26 and 28, are shown in approximately a 45 degree deployment. If that is the selected full extent of deployment, the control system described herein can operate the flaps to any position between 0 and 45 degrees, depending on the desired movement. Any position beyond "0" is considered a deployed position.

As seen in FIG. 2, a longitudinal axis "A" of the vehicle 10 is defined by the intersection of a first plane of symmetry "B-B-" and a second plane of symmetry "C-C." The two planes of symmetry B-B and C-C divide the body 12 into four quadrants I, II, III and IV. Each flap has a centerline 26*c*, 28*c*, 30*c*, and 32*c*, each of which is in a plane offset from but parallel to one of the planes of symmetry. The centerlines are also offset from the longitudinal axis A of the vehicle 10. The centerlines are substantially perpendicular to their respective pivot axes, and the pivot axes are substantially perpendicular to the longitudinal axis A of the vehicle 10.

The offset of flap 26 positions a major portion of the control surface of flap 26 into quadrant IV, whereas the diametrically opposed flap 30 has a major portion of its control surface in quadrant II. Thus, opposite flaps 26 and 30 are diametrically offset with respect to each other. Similarly, the major portion of the control surface of flap 28 is in quadrant IV, while the major portion of the control surface of flap 32 is in quadrant II. Thus, opposite flaps 28 and 32 are diametrically offset with respect to each other. Preferably the amount by which the centerline 26*c* of flap 26 is offset from the plane of symmetry B-B is the same amount by which the centerline 30*c* of flap 30 is offset from the plane of symmetry B-B, but the offset is in an opposite direction.

A similar relationship exists with respect to flaps 28 and 32 relative to the plane of symmetry C-C. In particular, the amount by which the centerline 28*c* of flap 28 is offset from the plane of symmetry C-C is the same amount by which the centerline 32*c* of flap 32 is offset from the plane of symmetry C-C, but the offset is in an opposite direction, meaning to the opposite side of the plane of symmetry C-C. The result is that quadrants I and III are minor surface portions of the flaps while quadrants II and IV have major portions of the flaps. This offsetting of flaps creates eccentric forces that lead to the generation of pitch, roll and yaw moments, depending on which flaps are actuated into deployed positions.

Figure 3:
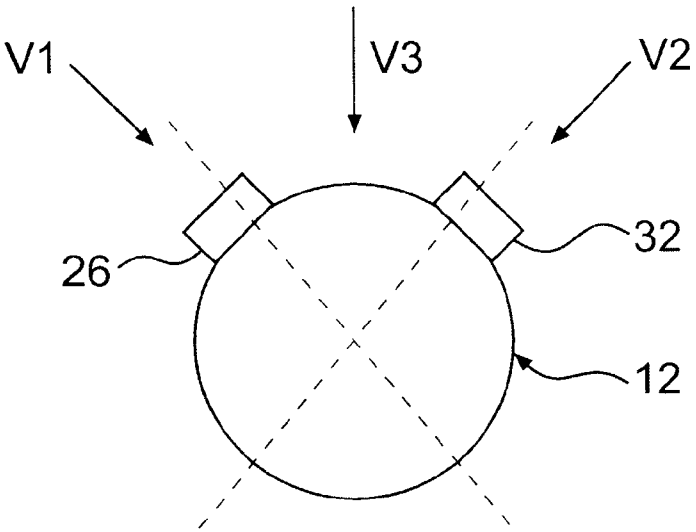
FIG. 3 is a rear schematic view of the vehicle of FIG. 1, with a first pair of the four flaps deployed to effect positive pitch, and wherein the flaps of the deployed pair are offset away from each other.

FIG. 3 illustrates an example of how the flaps are actuated to achieve a positive pitch movement in the body 12. To create positive pitch, flaps 26 and 32 are deployed while the other two flaps remain stowed. The deployment of flaps 26 and 32 must be to the extent that equal moments are generated on opposite sides of the vehicle longitudinal axis, thereby creating a positive pitch moment which causes the nose of the body 12 to pivot upwardly about the center of gravity. By simple addition of force vectors, flap 26 generates a force V1 having downward and sideward components. Flap 32 generates equal downward and sideward components in force V2, but the sideward component is opposite the sideward component generated by flap 26. When the force vectors are added, the combine force vector V3 has only a combined downward force. Since the force vector V3 is aft of the center of gravity, the nose of the body 12 pivots upwardly about a horizontal pivot axis passing through the center of gravity, thus producing positive pitch. If the flaps were disposed forward of the center of gravity, an opposite effect would occur, such that the pitch would he negative.

Figure 4:
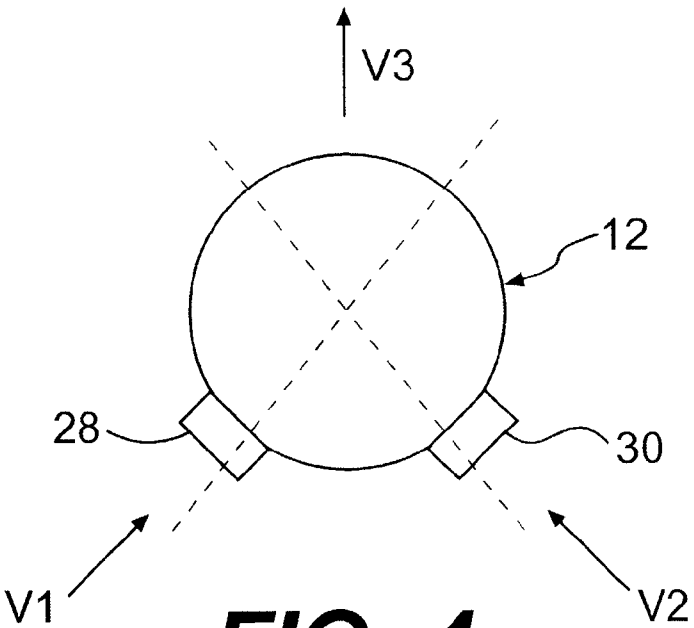
FIG. 4 is a rear schematic view of the vehicle of FIG. 1, with a second pair of the four flaps deployed to effect negative pitch, and wherein the flaps of the deployed pair are offset away from each other.

FIG. 4 illustrates how, with the center of gravity forward of the flaps, deployment of flaps 28 and 30 generate a negative pitch. Each of the flaps 28 and 30 produces a force vector V1 and V2, having equal upward components, but opposite sideward components that cancel each other when the force vectors are added to produce the upward force vector V3. Since the flaps are aft of the center of gravity, the upward force vector causes the body 12 to pivot about a horizontal pivot axis passing through the center of gravity, thus causing the nose of the body to move downwardly and thereby generating negative pitch.

Figure 6:
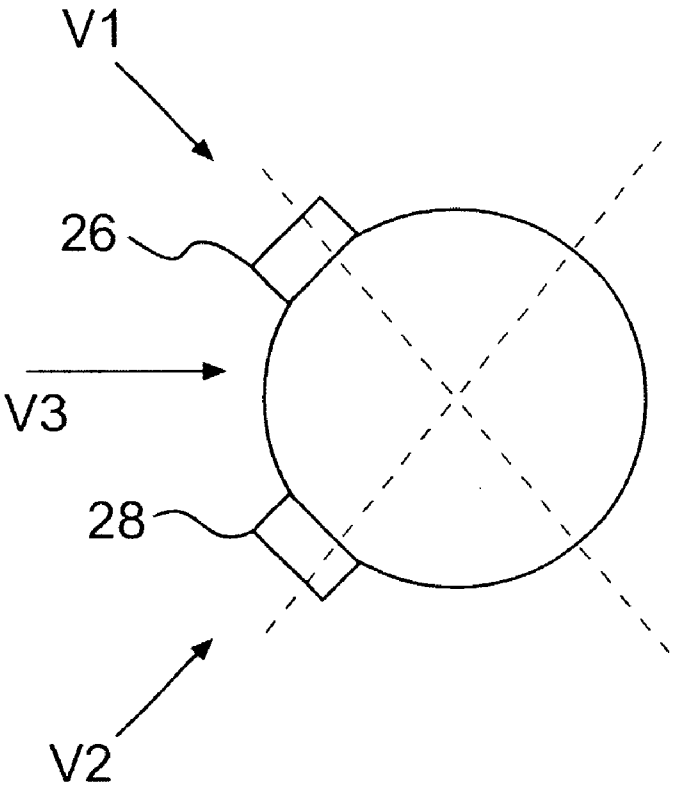
FIG. 6 is a rear schematic view of the vehicle of FIG. 1, with a fourth pair of the four flaps deployed to effect negative yaw, and wherein the flaps of the deployed pair are offset towards each other.
Figure 5:
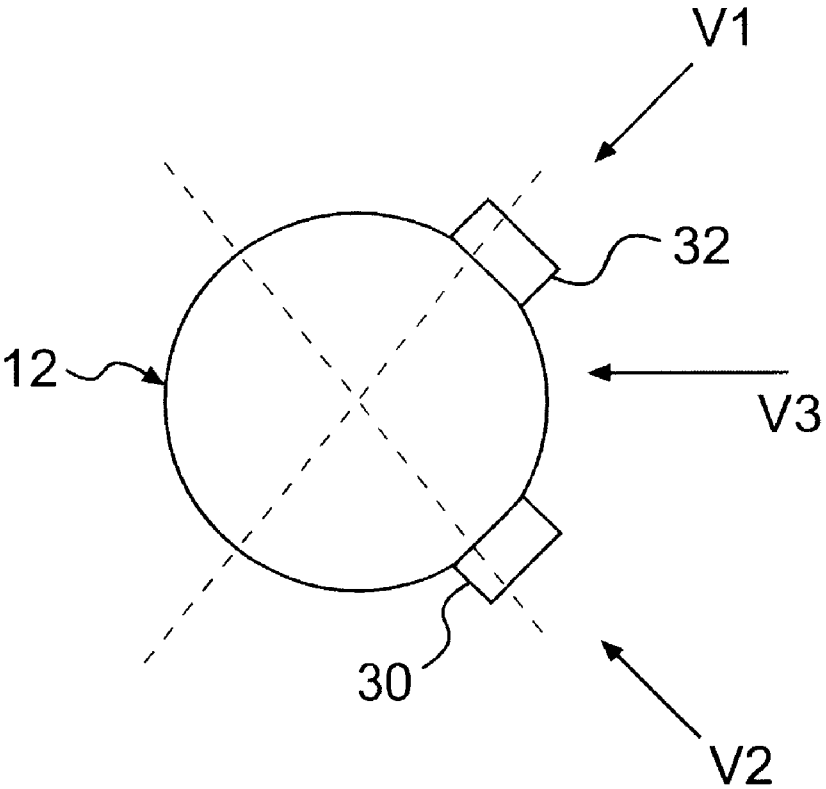
FIG. 5 is a rear schematic view of the vehicle of FIG. 1, with a third pair of the four flaps deployed to effect positive yaw, and wherein the flaps of the deployed pair are offset towards each other.

FIG. 5 illustrates a flap deployment that generates positive yaw, i.e., nose movement from left to right. By deploying flaps 30 and 32, while leaving flaps 26 and 28 stowed, force vectors V1 and V2 are generated. In this case, the vertical components of vectors V1 and V2 cancel each other out so that the net force vector V3 produces a sideward force. Since the flaps are aft of the center of gravity, this sideward force causes the nose to move to the right. FIG. 6 shows the opposite or negative yaw movement, generated when flaps 26 and 28 are deployed. The vector addition described above produces a combined, sideward or horizontal force vector V3 that causes the body 12 to rotate about a vertical axis passing through the center of gravity, thus causing the nose to move from right to left and thereby generating negative yaw.

Figure 8:
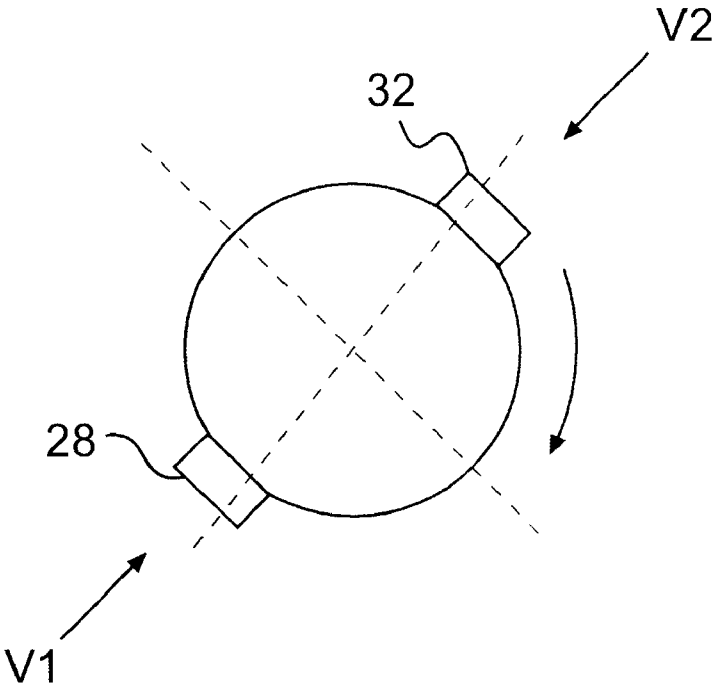
FIG. 8 is a rear schematic view of the vehicle of FIG. 1, with a sixth pair of the four flaps deployed to effect positive, or clockwise, roll, and wherein the flaps of the deployed pair are diametrically opposed, with centerlines of the flaps disposed on opposite sides of a plane of symmetry.
Figure 7:
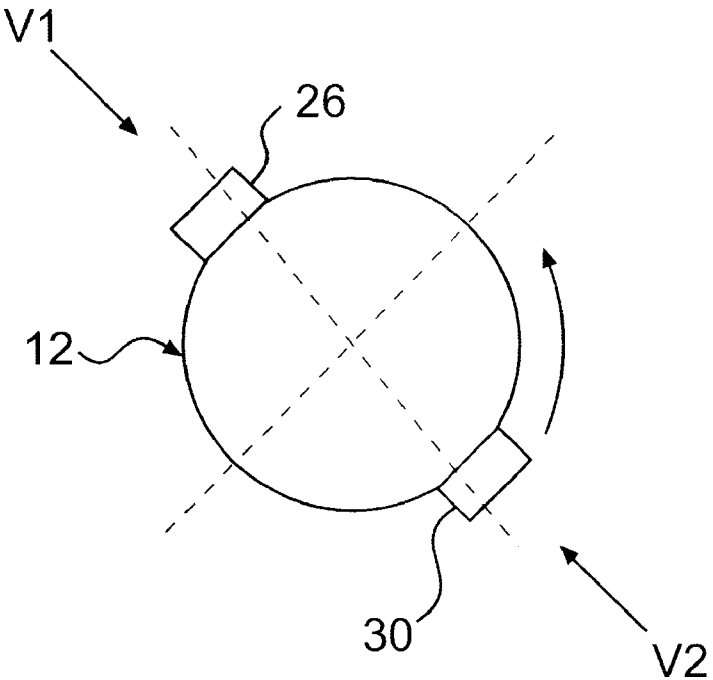
FIG. 7 is a rear schematic view of the vehicle of FIG. 1, with a fifth pair of the four flaps deployed to effect negative, or counter-clockwise, roll, and wherein the flaps of the deployed pair are diametrically opposed, with centerlines of the flaps disposed on opposite sides of a plane of symmetry.

FIGS. 7 and 8 illustrate a flap deployment scheme in which negative (counterclockwise) roll and positive (clockwise) spin is imparted in the body 12. Referring to FIG. 7, diametrically opposed, but offset flaps 26 and 30 produce, respectively, force vectors V1 and V2, each having vertical and horizontal components. The horizontal and vertical components cancel each other out, thus resulting in no pitch or yaw moments, i.e., no rotations about axes passing through the center of gravity. However, since the force vectors V1 and V2 do not pass through the center of the body, a spin is imparted, thus causing the body 12 to spin in the counter-clockwise direction.

In FIG. 8, flaps 28 and 32 are deployed to generate positive spin, i.e., spin in the clockwise direction. As in FIG. 7, force vectors V1 and V2 have horizontal and vertical components that cancel each other to thus prohibit rotation about an axis passing through the center of gravity. The spinning motion causes the body 12 to rotate about the longitudinal axis of the body 12.

Figure 9:
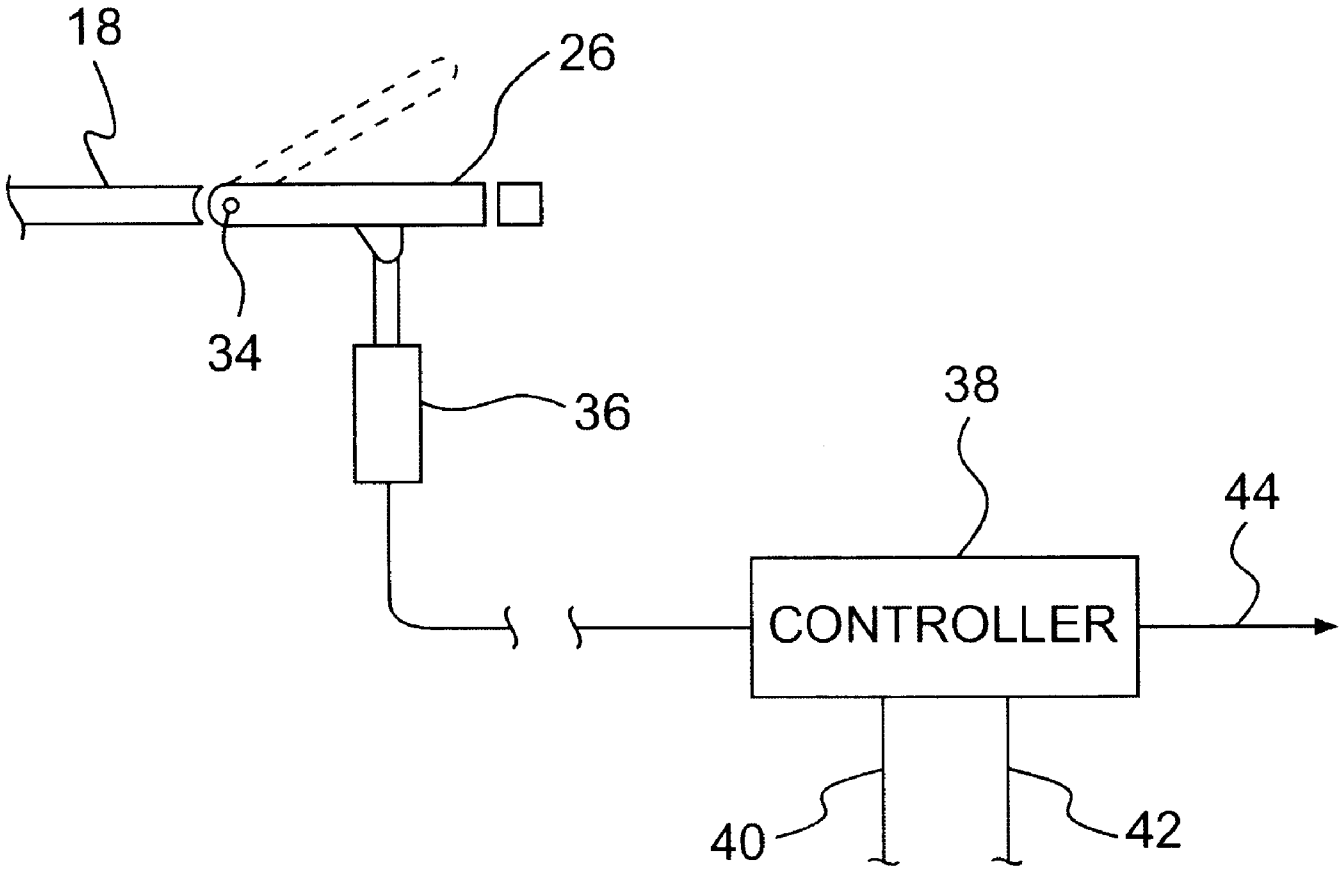
FIG. 9 is a schematic diagram showing a flap and actuator structure, coupled to a controller.

Any number of standard actuator means can be employed to move the flaps from their stowed positions to their deployed positions. As seen in FIG. 9, flap 26 is pivotally mounted at its leading edge for pivotal movement about mounting pin 34. The pivot axis defined by the mounting pin 34 is transverse the longitudinal axis of the body 12. Preferably, the pivot axes of all four flaps lie in a common, transverse plane. In the non-deployed position of the flap 26, the outer surface of the flap 26 is flush with the surface of the planar section 18. The lower surface of the flap 26 is connected to an actuator 36 which responds to a control signal issuing from controller 38. In the illustrated embodiment, the actuator is a linear actuator that has an extendable arm which is pivotally connected to the flap 26. The arm is extendable to whatever extent is commanded by the controller 38. For example, the full extent of deployment may be 30 degrees, as shown by the phantom line drawing of the flap. The controller 38 may command that the degree of deployment is any amount between zero (non-deployed) to 30 degrees (fully deployed).

The linear actuator 36 can be hydraulic, pneumatic or electric, depending on space and weight requirements. Also, the mechanism for actuation can be any other type other than linear, including gear driven, inflatable bladders, etc. Each flap is required to have its own actuator. Redundant actuators of the same or different types may also be employed as a safeguard against failure.

The controller can be any of a variety of standard control technologies. For example, the controller 38 may include a programmed microprocessor capable of executing pre-programmed telemetry data to effect desired pitch, roll and/or yaw movements. The controller may include feedback circuitry whereby flight data is fed to the controller, and the programmed telemetry data is changed on the fly to compensate for real flight data. The feedback data may be from sensors (not shown) provided on or in the projectile, or data may be transferred via radio frequency transmission. In that case, the controller would include receiver circuitry and a receive antenna for receiving signals from either a ground station, air or space-based station, or from orbiting satellites, such as the GPS constellation.

FIG. 9 shows control signal coupling lines 40, 42 and 44 for coupling the controller 38 to the other actuators (not shown) of the other three flaps. The coupling lines may be hard wired connections, either copper or fiber optic, or they could be wireless couplings, in which case the lines schematically represent the connections between a transmitter in the controller 38 to receivers in the actuators.

As noted previously, the flaps may be positioned along other axial positions with respect to the body 12, and can be, for example, forward of the center of gravity. If forward of the center of gravity, the flap movements will generate opposite effects, i.e., in pitch and yaw, negative pitch and yaw rather than positive. It should also be noted that the flaps could be deployed on any number and variety of vehicles. While the illustrated embodiment is of a hypersonic reentry vehicle, which in effect is the payload of a rocket booster and motor, the flaps could be disposed on the rocket booster, rather than the payload, so that control movements are made before separation of the payload from the booster. In general, the flaps can be mounted on any part of a vehicle. However, the configuration of four flaps operates best with axi-symmetric bodies, meaning those of nearly circular cross-section. Also, while the invention has been described with reference to bodies traveling at hypersonic speeds, it is expected that positive results will be achieved for supersonic vehicles as well.

It is additionally seen from the above that the flaps are not equally spaced around vehicle 20. Flaps 26 and 28 are offset toward each other, as are flaps 30 and 32. This balancing of flap offset allows vehicles employing the present control system to achieve pure pitch, yaw, and roll movements. Thus, use of flaps provides not only pitch and yaw control, but also bi-directional roll control with a minimum number of parts and minimal infringement of packaging envelope. Since the flaps are relatively small, mutual interference between the flaps is negligible. Small flap size also mitigates the rotational effect of a crosswind. The flaps allow for roll capability without the necessity of bank-to-turn flight, and thus the flaps provide some level of control in a fourth dimension—the axial translational dimension.

The present invention provides quick response and increased capability for difficult maneuvers such as the necessity to bleed off speed, navigate to a target, and meet angle of obliquity (flight path relative to the ground) and angle of attack (body orientation relative to flight path) requirements.

While the preferred embodiments of the present invention have been described above, it should be understood that they have been presented by way of example only, and not of limitation. It will be apparent to persons skilled in the relevant art that various changes in form and detail can be made therein without departing from the spirit and scope of the invention. Thus the present invention should not be limited by the above-described exemplary embodiments, but should be defined only in accordance with the following claims and their equivalents.

What is claimed is:

1. A control system for a missile having an outer surface, comprising:

moveable flaps positioned on the outer surface, each flap being moveable between a closed position and an open position, each flap having a centerline and being positioned such that said flap centerline is offset from and substantially parallel to a missile centerline when said flap is in said closed position;

an actuator operatively coupled to said flaps; and a controller operatively coupled to said actuator to control said actuator.

2. The control system of claim 1, wherein said control system comprises:

four moveable flaps;

four actuators, each actuator being operatively coupled to a separate one of said four flaps; and wherein said controller is operatively coupled to said actuators so as to independently control each actuator.

3. The control system of claim 1, wherein:

the outer surface has a tail end; and each of said flaps is positioned toward said tail end.

4. The control system of claim 1, further comprising:

a sensor operatively coupled to said controller to provide input to said controller.

5. The control system of claim 1, wherein:

each of said flaps is moveable from a first position, in which said flaps are substantially flush with the outer surface, to a second position, in which at least a portion of said flaps is extended away from the outer surface.

6. The control system of claim 1, wherein said actuator is chosen from the group consisting of a motor driven geared actuator, a hydraulic actuator, and a pneumatic actuator.

7. A method of controlling the flight of a missile, comprising:

providing a missile having an outer surface and moveable flaps positioned on said outer surface, each flap bring moveable between a closed position and an open position, each flap having a centerline and being positioned such that each of said flap centerlines is offset from and substantially parallel to a missile center line when the flaps are in the closed positions;

sensing an environmental characteristic;

determining whether to alter an orientation of said missile based at least in part on said environmental characteristic; and engaging said flaps to induce a yaw, a pitch, or a roll movement of said missile.

8. The method of claim 7, further comprising:

receiving feedback from said flaps.

9. The method of claim 7, further comprising:

sensing a new missile orientation; and disengaging said flaps.

10. A missile capable of traveling in excess of supersonic speeds, comprising:

a body having an outer surface;

an array of flaps, each flap of the array being selectively movable between a stowed position and a deployed position;

at least one actuator operatively coupled to the array of flaps; and a controller operatively coupled to the at least one actuator for selectively controlling paired flaps of the array of flaps to effect pitch, roll and yaw control of the missile;

wherein each flap has a centerline that is offset from and substantially parallel to a centerline of the missile when in the stowed position.

11. A missile according to claim 10, wherein the array of flaps includes first, second, third and fourth flaps, wherein the first and second flaps are diametrically opposed to each other, and each of the first and second flaps has a centerline, the centerline of the first and second flaps being offset in opposite directions relative to a first plane of symmetry.

12. A missile according to claim 11, wherein the third and fourth flaps are diametrically opposed to each other, and each of the third and fourth flaps has a centerline, the centerline of the third and fourth flaps being offset in opposite directions relative to a second plane of symmetry.

13. A missile according to claim 12, wherein the controller includes means for commanding the deployment of a first pair of diametrically opposed flaps which, when deployed, generate a roll force that causes the missile to undergo roll motion in a first direction.

14. A missile according to claim 13, wherein the controller includes means for commanding the deployment of a second pair of diametrically opposed flaps which, when deployed, generate a roll force that causes the missile to undergo roll motion in a second, opposite direction.

15. A missile according to claim 12, wherein the controller includes means for commanding the deployment of a third pair of flaps that are offset towards each other which, when deployed, generate a yaw force that causes the missile to undergo yaw motion in a first direction.

16. A missile according to claim 15, wherein the controller includes means for commanding the deployment of a fourth pair of flaps that are offset towards each other which, when deployed, generate a yaw force that causes the missile to undergo yaw motion in a second direction.

17. A missile according to claim 12, wherein the controller includes means for commanding the deployment of a fifth pair of flaps that are offset away from each other which, when deployed, generate a pitch force that causes the missile to undergo pitch motion in a first direction.

18. A missile according to claim 17, wherein the controller includes means for commanding the deployment of a sixth pair of flaps that are offset away from each other which, when deployed, generate a yaw force that causes the missile to undergo yaw motion in a second direction.

* * * * *